US005722649A

United States Patent [19]

Morris

[11] Patent Number: 5,722,649

[45] Date of Patent: Mar. 3, 1998

[54] ADJUSTABLE CLAMP

[76] Inventor: Milton I. Morris, 2701 W. Main, P.O. Box 260, Odessa, Mo. 64076

[21] Appl. No.: 721,228

[22] Filed: Sep. 26, 1996

[51] Int. Cl.[6] ..... B25B 1/02

[52] U.S. Cl. ..... 269/171; 269/212

[58] Field of Search ..... 269/147, 165–171.5, 269/180, 207, 209, 212, 246, 250

[56] References Cited

U.S. PATENT DOCUMENTS

| | | | |
|---|---|---|---|
| 292,391 | 1/1884 | Weiser | 269/212 |
| 307,439 | 11/1884 | Corbett . | |
| 514,614 | 2/1894 | Brintnall | 269/171 |
| 775,659 | 11/1904 | Jorgensen | 269/165 |
| 881,530 | 3/1908 | Barker | 269/212 |
| 912,543 | 2/1909 | Cobb | 269/166 |
| 1,004,743 | 10/1911 | Cobb | 269/212 |
| 1,201,461 | 10/1916 | Hargrave . | |
| 1,638,848 | 8/1927 | Hargrave . | |
| 1,783,713 | 12/1930 | Holman . | |
| 1,806,527 | 5/1931 | Eisemann . | |
| 1,914,291 | 6/1933 | Reid . | |
| 1,930,177 | 10/1933 | Miller et al. . | |
| 2,061,217 | 11/1936 | Watcher . | |
| 2,656,864 | 10/1953 | Hopfeld . | |
| 2,796,097 | 6/1957 | Garner . | |
| 2,923,334 | 2/1960 | Brennan, Jr. . | |
| 3,107,909 | 10/1963 | Kuchenbecker | 269/171.5 |
| 4,306,710 | 12/1981 | Vosper . | |
| 5,002,264 | 3/1991 | Nimtz . | |
| 5,064,178 | 11/1991 | Nimtz . | |
| 5,443,246 | 8/1995 | Peterson . | |

*Primary Examiner*—Robert C. Watson

*Attorney, Agent, or Firm*—Hovey,Williams, Timmons & Collins

[57] ABSTRACT

An adjustable clamp includes a compression jaw and an anvil jaw shiftable along the length of a structural member to a selected location. The anvil jaw pivots into a stop position when under compression from a work piece positioned between the jaws. In the stop position, the anvil jaw work face is parallel to the compression jaw work face and is prevented from shifting relative to the structural member.

8 Claims, 1 Drawing Sheet

ADJUSTABLE CLAMP

BACKGROUND OF THE INVENTION

1. Field of the Invention

The present invention relates to the field of mechanical clamps. In particular, the invention is concerned with an adjustable clamp including compression jaw and an anvil jaw shiftable along the length of a structural member to a selected location.

2. Description of the Prior Art

The prior art discloses a variety of configurations for adjustable clamps having a compression jaw and an anvil jaw shiftable relative to a structural member for adjusting the span between the jaws in order to accommodate different sizes of work pieces. Typically the compression jaw is mounted to a screw that allows this jaw to be shifted forcefully in order to compress and thereby securely hold a work piece between the jaws.

These prior art devices present various problems. The structure of the anvil jaw is often mechanically complex or difficult to fabricate. Moreover, these prior art devices often use a structural member that must be custom manufactured. Accordingly, the prior art points out the need for an adjustable clamp that is economical to manufacture, easy to use and can be used with conventional structural members.

SUMMARY OF THE INVENTION

The present invention solves the prior art problems discussed above and provides a distinct advance in the state of the art. In particular, the adjustable clamp hereof provides a shiftable anvil jaw that is mechanically simple and economical to manufacture, easy to use and mounts to an off-the-shelf structural member.

The preferred embodiment includes a channel-shaped structural member, an anvil assembly and a compression assembly. The preferred structural member presents a web and a pair of spaced flanges defining a channel therebetween. In particularly preferred forms, the structural member is known as UNISTRUT brand structural material and the flanges present respective U-shaped sections extending into the channel and opening toward the web with edges spaced from the web.

The preferred anvil assembly includes an anvil jaw having support surfaces configured to engage the flange support shoulders defining the channel opening. A tab extends from the anvil jaw into the channel and presents a pivot surface that engages the web.

When a work piece is compressed between the compression and anvil jaws, the anvil jaw pivots about pivot surface to a stop position. In this position, the anvil assembly is prevented from slidable movement relative to the structural member. In preferred forms, a stop piece extends from the tab within the channel and engages the edges of the U-shaped sections to prevent further pivoting of the anvil assembly. A plurality of slots defined in the web correspond to selected locations along the structural member and are configured to receive the pivot surface in order to prevent sliding of the anvil assembly when in the stop position.

DETAILED DESCRIPTION OF THE PREFERRED EMBODIMENT

Figures 1, 2, 3, 4:
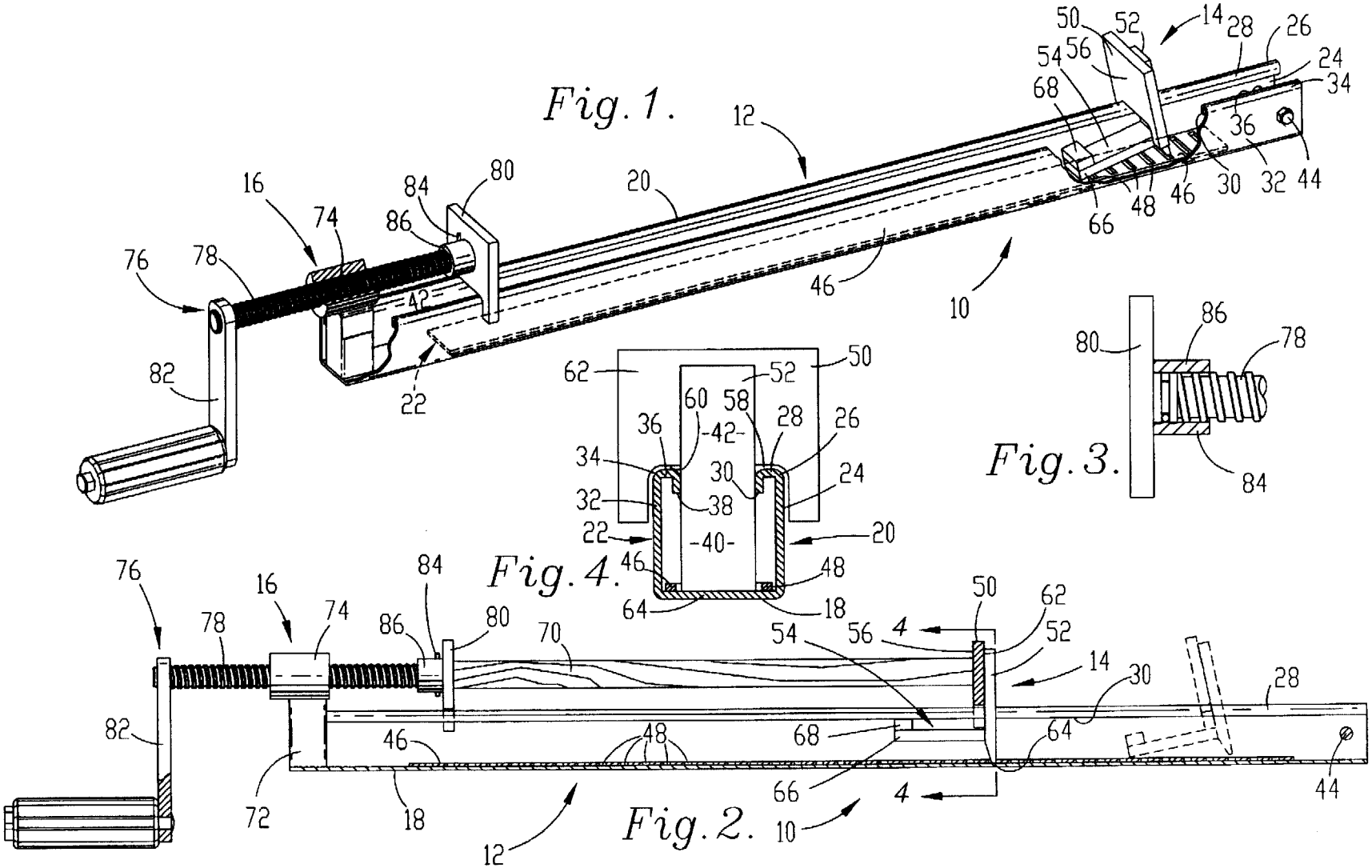
FIG. 1 is a perspective view of the adjustable clamp made in accordance with the present invention with portions cut away for clarity of illustration and other portions shown in phantom lines.
FIG. 2 is an elevational view in partial section of the clamp of FIG. 1 with phantom lines showing the anvil assembly in the shifting position.
FIG. 3 is cut away view in partial section of the compression jaw and screw of the clamp of FIG. 1.
FIG. 4 is a sectional view taken along line 4—4 of FIG. 2.

Referring to the drawing figures, and in particular to FIG. 1, adjustable clamp 10 as the preferred embodiment of the present invention includes channel shaped structural member 12, anvil assembly 14 and compression assembly 16. Structural member 12 is preferably configured to present the shape of UNISTRUT structural material as best viewed in FIG. 4. Structural member 12 is composed of steel and includes web 18 and spaced flanges 20 and 22 extending from opposed sides of web 18.

Flange 20 includes side wall 24 and U-shaped section 26 extending inwardly and opening downwardly as illustrated in FIG. 4 toward web 18. The upper surface of section 26 presents arcuately shaped support shoulder 28 and section 26 terminates with edge 30. Similarly, flange 22 includes side wall 32, U-shaped section 34, support shoulder 36 and edge 38. Flanges 20, 22 define channel 40 therebetween and shoulders 28, 36 define channel opening 42 therebetween. Retaining bolt 44 extends through side walls 24, 32 adjacent the end of structural member 12 remote from compression assembly 16 for retaining anvil assembly 14 within member 12.

Structural member 12 further includes steel strap 46 coupled with web 18, preferably by welding. Strap 46 includes a plurality of spaced, parallel locking slots 48 configured transverse to member 12 as illustrated in FIG. 1. Slots 48 define a plurality of selectable locations for anvil assembly 14.

Anvil assembly 14 includes anvil jaw 50, tab 52 and stop piece 54. Anvil jaw 50 presents work face 56 positioned toward compression assembly 16 and includes support surfaces 58 and 60 configured to engage support shoulders 28, 36 with anvil jaw 50 spanning channel opening 42.

Tab 52 is connected, preferably by welding, to reverse face 62 of jaw 50 and presents a width narrow enough to extend through channel opening 42 into channel 40. The distal end of tab 52 presents pivot surface 64 and is configured for reception in a selected one of slots 48.

Stop piece 54 includes extension 66 having one end welded to the face of tab 52 in order to extend transversely from tab 52 and toward compression assembly 16, and further includes stop block 68 welded to the upper surface of extension 66 adjacent the distal end thereof. FIG. 2 illustrates anvil assembly 14 in the stop position (solid lines) with one end of a work piece 70 engaging jaw work face 56. In this position, pivot surface 64 is received in a selected slot 48 and jaw 50 is transverse to web 18, that is, upright as viewed in FIG. 2.

Stop piece 54 is configured so that when anvil assembly 14 is in the stop position as illustrated in FIG. 4, stop block 68 engages flange edges 30, 38 and prevents further pivoting of anvil jaw 50 in the clockwise direction as viewed in FIG. 2. More particularly, stop block 68 is wide enough to span the width of channel opening 42 and is precisely configured so that when jaw work face 56 is in the stop position, it is parallel to the jaw of compression assembly 16. Also in the stop position, the distal end of tab 52 received in slot 48 prevents sliding of anvil assembly 14.

FIG. 2 also illustrates anvil assembly 14 in the sliding position as shown in dashed lines. In this position, pivot surface 64 is not received in a slot 48 and anvil assembly 14 is rotated counter-clockwise as viewed in FIG. 2. In the sliding position, anvil assembly 14 is free to slide along the length of structural member 12 to one of the selectable locations defined by slots 48. The desired location is determined generally by the length of work piece 70. When the location is selected, pivot surface 64 is positioned in the selected slot 48 and anvil assembly 14 rotated clockwise until stop block 68 engages edges 30, 38. This can be accomplished manually or by pressing one end of work piece 70 against jaw work face 56 until compression assembly 16 sufficiently compresses work piece 70 to hold anvil assembly 14 in the stop position.

Compression assembly 16 includes support block 72 welded in channel 40 at one end of structural member 12, tubular, internally threaded, screw block 74 welded to the upper end of support block 72 just above flanges 20, 22 and axially parallel with structural member 12, and crank 76. Crank 76 includes screw 78 threadably received in screw block 74, compression jaw 80 rotatably mounted to the inboard end of screw 78, and crank handle 82 fixedly coupled with the opposed, Outboard end of screw 78. Retaining pin 84 is received through bushing 86 welded to the reverse face of compression jaw 80 and rotatably receives screw 78 as illustrated in FIG. 3. As viewed in FIG. 1, clockwise rotation of handle 82 advances compression jaw 80 toward anvil assembly 14 and counter-clockwise rotation moves compression jaw 80 away from anvil assembly 14.

In order to use clamp 10, a user rotates crank handle 82 counter clockwise in order to shift compression jaw 80 away from anvil assembly 14. Anvil assembly 14, in the sliding position, is then shifted along structural member 12 so that the distance between anvil jaw 50 and compression jaw 80 is slightly greater than the length of the work piece. As will be appreciated, anvil assembly 14 is biased toward the sliding position under the weight of extension 66 and stop block 68.

The user then slips pivot surface 64 into the nearest slot and, using one hand, butts one end of the work piece against anvil work face 56. This action pivots anvil assembly 14 toward the stop position. While held in the stop position, the user then turns handle 82 with the other hand in the clockwise direction until compression jaw 80 engages the other end of the work piece with sufficient force to hold the work piece in position between jaws 50, 80. Handle 82 can then be rotated more in order to clamp the work piece as firmly as needed.

Those skilled in the art will appreciate that users may develop other techniques for mounting a work piece in clamp 10 and find many uses for clamp 10. For example, clamp 10 could be bolted or otherwise secured to a work bench and used in the nature of a vise for variously sized work pieces. As another example, clamp 10 can be used in other orientations for clamping wood pieces in position after gluing.

It will also be appreciated that the present invention encompasses many variations in the preferred embodiment described herein. For example, instead of slots 48, a plurality of spaced ridges or scoring for friction resistance could be used to prevent sliding of anvil assembly 14 in the stop position. While steel is preferred for the various components, other materials may also be used equivalently.

Having thus described the preferred embodiment of the present invention, the following is claimed as new and desired to be secured by Letters Patent:

1. An adjustable clamp apparatus for use with a channel-shaped structural member having a web and a pair of spaced flanges cooperatively defining a channel therebetween, each of said flanges having a lower end adjacent said web, an opposed upper end and a sidewall therebetween and including an inverted, U-shaped section adjacent said upper end and opening toward said web, each of said U-shaped sections having a pair of inner and outer legs and a bight portion therebetween, each of said outer legs extending from a corresponding sidewall, each of said inner legs extending into said channel and having respective inward edges spaced from said web, each of said bight portions presenting an outboard support shoulder, said support shoulders cooperatively defining a channel opening therebetween, said clamp apparatus comprising:

an anvil assembly including an anvil jaw and first coupling means for operatively coupling said anvil jaw with said structural member for selective shifting of said anvil jaw to a location along and relative to said structural member; and a compression assembly including a compression jaw and second coupling means for operatively coupling said compression jaw with said structural member in alignment with said anvil jaw and for selective movement of said compression jaw relative to said anvil jaw for clenching a work piece therebetween, said anvil jaw having an anvil work face and a pair of support surfaces configured for engaging said support shoulders of said structural member in spanning relationship with said channel opening, said first coupling means including a tab secured to said anvil jaw and depending therefrom and having a lowermost end, said tab being configured for extending into said channel and having a pivot surface adjacent said lowermost end and configured for engaging said web, said anvil assembly being configured for shifting between a sliding position in which said anvil assembly is slidable along and relative to said structural member and a stop position so that engagement of said anvil work face with said work piece causes pivoting of said anvil assembly about said pivot surface toward said stop position, said first coupling means further including an elongated stop piece secured to said tab and extending transversely therefrom within said channel and toward said compression assembly, said stop piece having a length greater than the thickness of said anvil jaw and including stop surfaces spaced from said anvil work face and configured for engaging said inward edges of said structural member for stopping the pivoting of said anvil assembly when said anvil assembly is in said stop position, and holding means for preventing shifting of said anvil assembly along and relative to said structural member when said anvil assembly is in said stop position.

2. The apparatus as set forth in claim 1, said compression jaw presenting a compression work face, said anvil work face being substantially parallel to said compression work face in said stop position.

3. The apparatus as set forth in claim 2, said holding means including a plurality of spaced, holding structures adjacent the web for holding said pivot surface for preventing slidable movement of said anvil assembly relative to the structural member when in said stop position, each of said holding structures corresponding to a selected location relative to the structural member.

4. The apparatus as set forth in claim 3, said holding structures including slot structure defining a plurality of spaced, transverse slots, each of said slots being configures for receiving and holding said pivot surface.

5. The apparatus as set forth in claim 4, said slot structure including a strap having said slots defined therein and affixed to the web within the channel.

6. The apparatus as set forth in claim 1, said compression assembly including a screw having said compression jaw rotatably mounted to one end thereof and further including a support block coupled with the structural member adjacent an end thereof and having a threaded opening defined therethrough for threadably receiving said screw so that rotation of said screw linearly moves said compression jaw relative to said anvil jaw.

7. The apparatus as set forth in claim 6, said compression assembly including a crank handle mounted to the other end of said screw for manual rotation thereof.

8. An adjustable clamp apparatus comprising:

a channel-shaped structural member having a web and a pair of spaced flanges cooperatively defining a channel therebetween, each of said flanges having a lower end adjacent said web, an opposed upper end and a sidewall therebetween and including an inverted, U-shaped section adjacent said upper end and opening toward said web, each of said U-shaped sections having a pair of inner and outer legs and a bight portion therebetween, each of said outer legs extending from a corresponding sidewall, each of said inner legs extending into said channel and having respective inward edges spaced from said web, each of said bight portions presenting an outboard support shoulder, said support shoulders cooperatively defining a channel opening therebetween;

an anvil assembly including an anvil jaw and first coupling means for operatively coupling said anvil jaw with said structural member for selective shifting of said anvil jaw to a location along and relative to said structural member; and a compression assembly including a compression jaw and second coupling means for operatively coupling said compression jaw with said structural member in alignment with said anvil jaw and for selective movement of said compression jaw relative to said anvil jaw for clenching a work piece therebetween, said anvil jaw having an anvil work face and a pair of support surfaces configured for engaging said support shoulders of said structural member in spanning relationship with said channel opening, said first coupling means including a tab secured to said anvil jaw and depending therefrom and having a lowermost end, said tab being configured for extending into said channel and having a pivot surface adjacent said lowermost end and configured for engaging said web, said anvil assembly being configured for shifting between a sliding position in which said anvil assembly is slidable along and relative to said structural member and a stop position so that engagement of said anvil work face with said work piece causes pivoting of said anvil assembly about said pivot surface toward said stop position, said first coupling means further including an elongated stop piece secured to said tab and extending transversely therefrom within said channel and toward said compression assembly, said stop piece having a length greater than the thickness of said anvil jaw and including stop surfaces spaced from said anvil work face and configured for engaging said inward edges of said structural member for stopping the pivoting of said anvil assembly when said anvil assembly is in said stop position, and holding means for preventing shifting of said anvil assembly along and relative to said structural member when said anvil assembly is in said stop position.

* * * * *